US008632144B2

(12) United States Patent
Nistor

(10) Patent No.: US 8,632,144 B2
(45) Date of Patent: Jan. 21, 2014

(54) FOOD STORAGE DRAWER AND CONTAINER

(76) Inventor: Alexandru Nistor, Toronto (CA)

( * ) Notice: Subject to any disclaimer, the term of this patent is extended or adjusted under 35 U.S.C. 154(b) by 0 days.

(21) Appl. No.: 13/360,674

(22) Filed: Jan. 28, 2012

(65) Prior Publication Data

US 2013/0193822 A1 Aug. 1, 2013

(51) Int. Cl.

| | |
|---|---|
| ***A47B 96/04*** | (2006.01) |
| ***A47B 96/00*** | (2006.01) |
| ***A47B 95/00*** | (2006.01) |

(52) U.S. Cl.

USPC ..... 312/404; 312/296

(58) Field of Classification Search

USPC ..... 312/296, 330.1, 333, 402, 404, 228, 312/198, 201, 111; 206/545

See application file for complete search history.

(56) References Cited

U.S. PATENT DOCUMENTS

| | | | | |
|---|---|---|---|---|
| 1,713,224 | A * | 5/1929 | Gunter | 292/256.63 |
| 2,117,807 | A * | 5/1938 | Jesser | 220/320 |
| 2,201,152 | A * | 5/1940 | Brockett | 312/270.3 |
| 2,246,342 | A * | 6/1941 | Brown | 62/266 |
| 2,755,158 | A * | 7/1956 | Davidson | 312/404 |
| 3,097,901 | A * | 7/1963 | Schless | 312/330.1 |
| 3,272,580 | A * | 9/1966 | Dean et al. | 312/409 |
| 3,606,506 | A * | 9/1971 | Ungaro | 312/111 |
| 4,173,378 | A * | 11/1979 | Hanson et al. | 312/296 |
| 5,157,940 | A * | 10/1992 | Bertu et al. | 62/382 |
| 7,665,327 | B2 * | 2/2010 | Tunzi | 62/441 |
| 7,935,160 | B2 * | 5/2011 | Holzmann et al. | 55/337 |
| 2007/0011950 | A1 * | 1/2007 | Wood | 49/478.1 |
| 2008/0134706 | A1 * | 6/2008 | Manzo | 62/337 |
| 2010/0083992 | A1 * | 4/2010 | Wrangberth et al. | 134/198 |

* cited by examiner

*Primary Examiner* — Janet M Wilkens
*Assistant Examiner* — Andrew Rosersma
(74) *Attorney, Agent, or Firm* — Elias Borges

(57) ABSTRACT

Here is disclosed a nearly air tight storage container for storing goods. The container includes a drawer having walls, an open top and a circumscribing rim surrounding the open top. The container further includes a housing for containing the drawer. The housing has a top wall and opposite side walls. The top wall has an underside with a peripheral rim. The side walls of the housing and the side walls of the drawer permitting the drawer to slide in and out of the housing between an open position and a closed position wherein the drawer is fully contained within the housing. The top wall of the housing is inclined such that when the drawer is in its closed position the top wall of the housing closes off the open top of the drawer with the circumscribing rim of the drawer sealing against the peripheral rim of the housing.

1 Claim, 9 Drawing Sheets

FOOD STORAGE DRAWER AND CONTAINER

FIELD OF THE INVENTION

The invention relates generally to storage containers for storing food.

BACKGROUND OF THE INVENTION

Most refrigerators have storage drawers for storing food products such as fruits, vegetables, cheese and luncheon meats. The shelves provide convenient access to the food because the shelves can simply be pulled open to gain access to the contents of the drawer. However, while the drawers are convenient, they are not effective in preserving foods which are prone to drying out, such as luncheon meats, cheese and leftovers because the drawers are far from being air tight. Plastic air tight containers have become the popular way of storing these perishable foods because they preserve the moisture in the foods. These containers usually consist of a bowl having a lid which is configured to fit the bowl in an air tight or nearly air tight fashion. When foods such as luncheon meats or leftovers are stored in one of these closed containers, they can remain in good condition for several days in a refrigerator. However, these containers suffer from one serious drawback. The individual containers must be removed and their lids removed before the contents can be removed. While the food containers can be stacked one on top of the other to save space in the refrigerator, they still have to be physically removed from the refrigerator shelf and have their lids removed. Therefore, while air tight plastic containers do increase the storage of various food products, they are often cumbersome and awkward to use. What is required is a system for storing food which is convenient to use as well as being air tight or nearly air tight.

SUMMARY OF THE INVENTION

In accordance with one aspect of the present invention, there is provided a nearly air tight storage container for storing goods. The container includes a drawer having a front wall, a back wall, side walls, a bottom and an open top with a handle formed on the front wall. The front and back walls each have a height, the height of the front wall being greater than the height of the back wall. The front wall, side walls and the back wall of the drawer form a circumscribing rim surrounding the open top. The container further includes a housing for containing the drawer. The housing has a top wall and opposite side walls depending from the top wall. The top wall has an underside with a peripheral rim formed thereon. The side walls of the housing and the side walls of the drawer have tongue and groove connectors to permit the drawer to slide in and out of the housing between an open position wherein the drawer is pulled out of the housing and a closed position wherein the drawer is fully contained within the housing. The top wall of the housing is inclined such that when the drawer is in its closed position the top wall of the housing closes off the open top of the drawer with the circumscribing rim of the drawer sealing against the peripheral rim of the housing.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
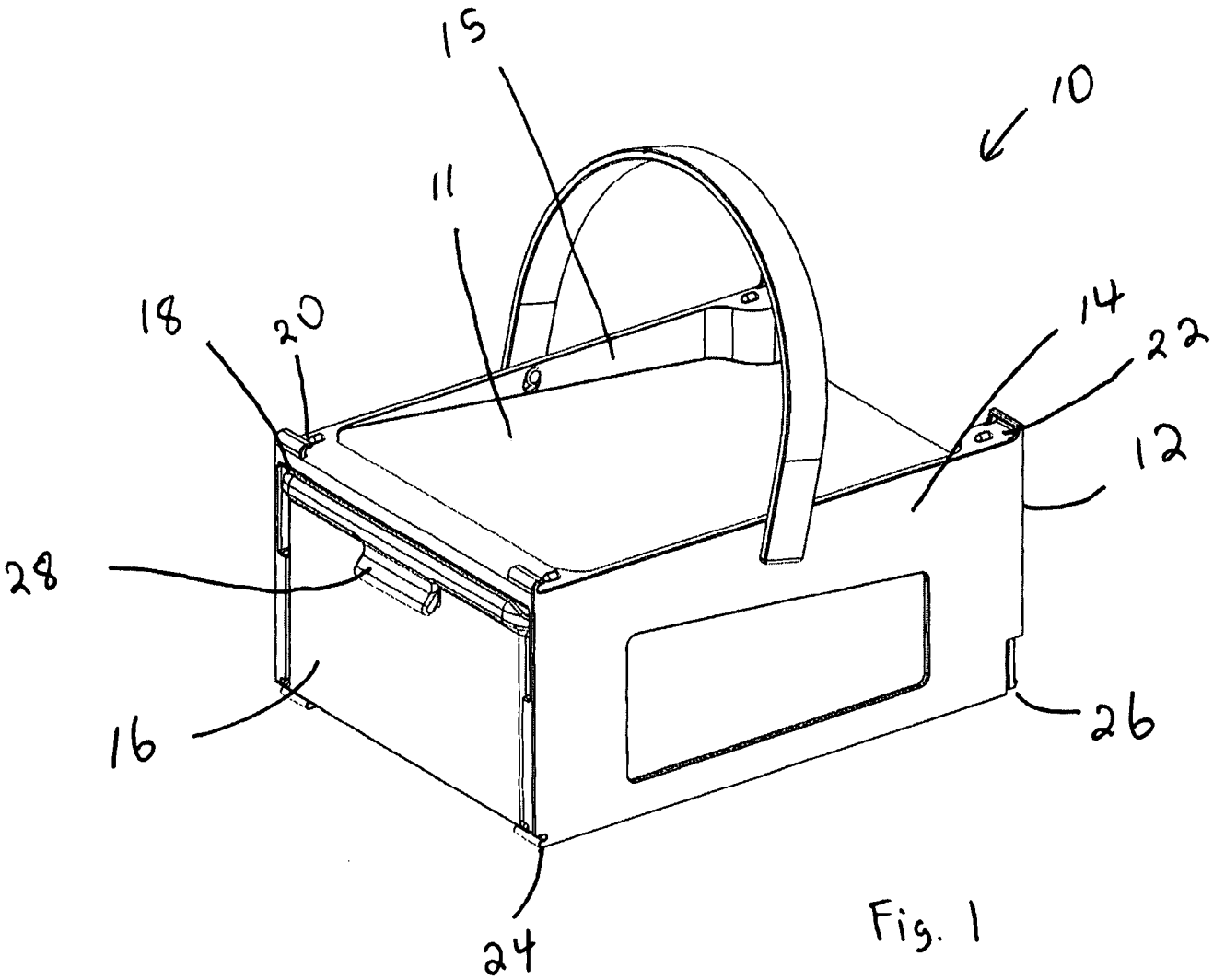
FIG. 1 is a perspective view of a storage container made in accordance with the present invention.

Referring to FIG. 1, a storage container made in accordance with the present invention is shown generally as item 10 and consists of a housing 12 having top wall 11, side walls 14 and 15 depending from the top wall and opening 18 formed by the top wall and the side walls. Drawer 16 is slidingly retained in housing 12 and is dimensioned to pass through opening 18. Drawer 16 is provided with handle 28 to make it easier to insert and remove the drawer from housing 12. Housing 12 has upper coupling elements 20 and 22 and lower coupling elements 24 and 26. Coupling elements 20/24 and 22/26 are complimentary to allow identical housings to be mounted to each other in a stacked arrangement.

Figure 2:
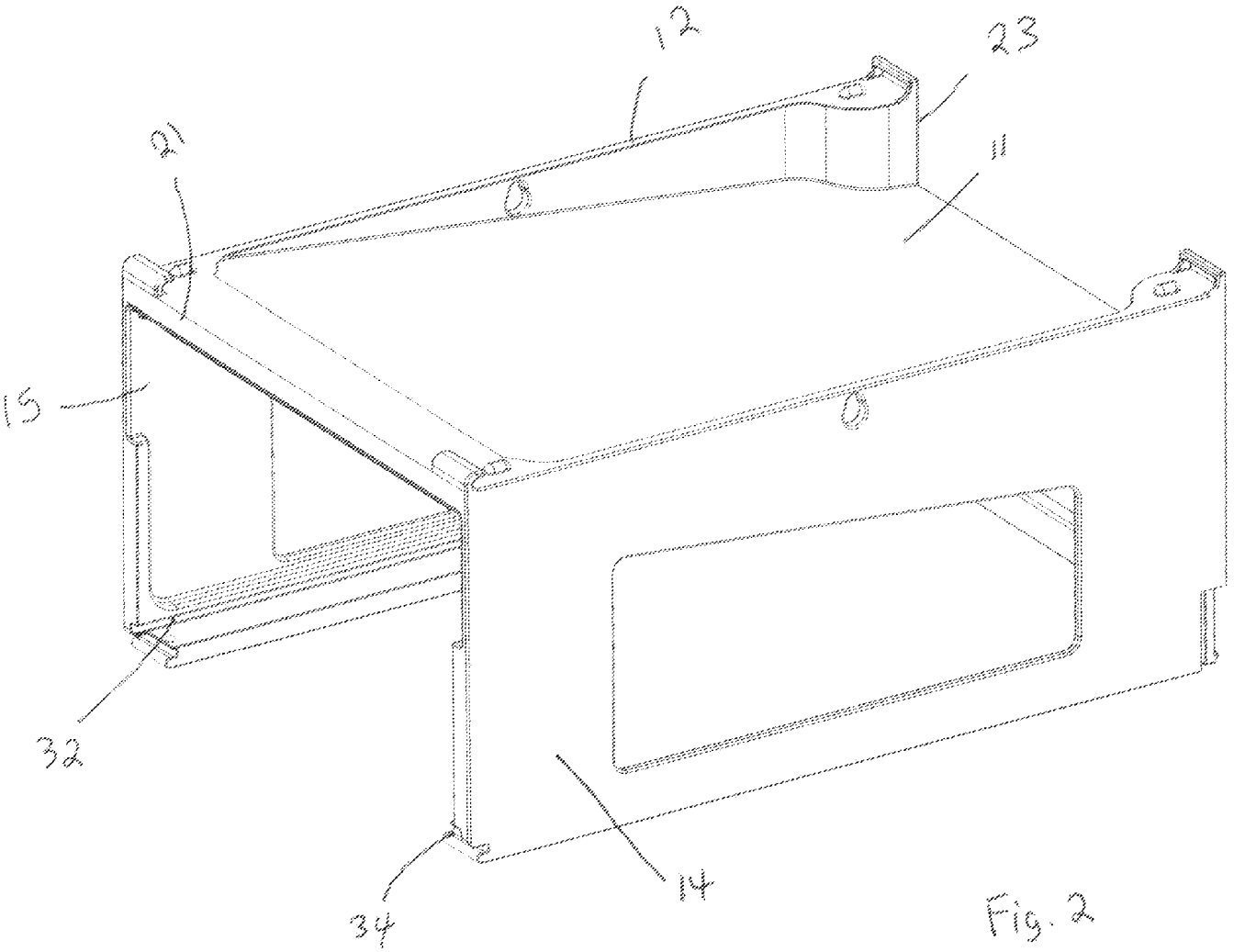
FIG. 2 is a perspective view of the housing portion of the storage container shown in FIG. 1.

Referring now to FIG. 2, side walls 15 and 14 of housing 12 are each provided with one half of a tongue and groove connector for permitting the drawer to be slidling mounted within the housing. Either an elongated tongue or groove could be formed on the side walls. In the present embodiment, side wall 15 has elongated groove 32 while side wall 14 has elongated groove 34. Grooves 32 and 34 extend along the entire length of side walls 15 and 14, respectively, from front 21 of housing 12 to back 23. Top wall 11 is inclined such that the portion of the top wall adjacent front 21 is higher than the portion of the top wall adjacent back 23.

Figure 3:
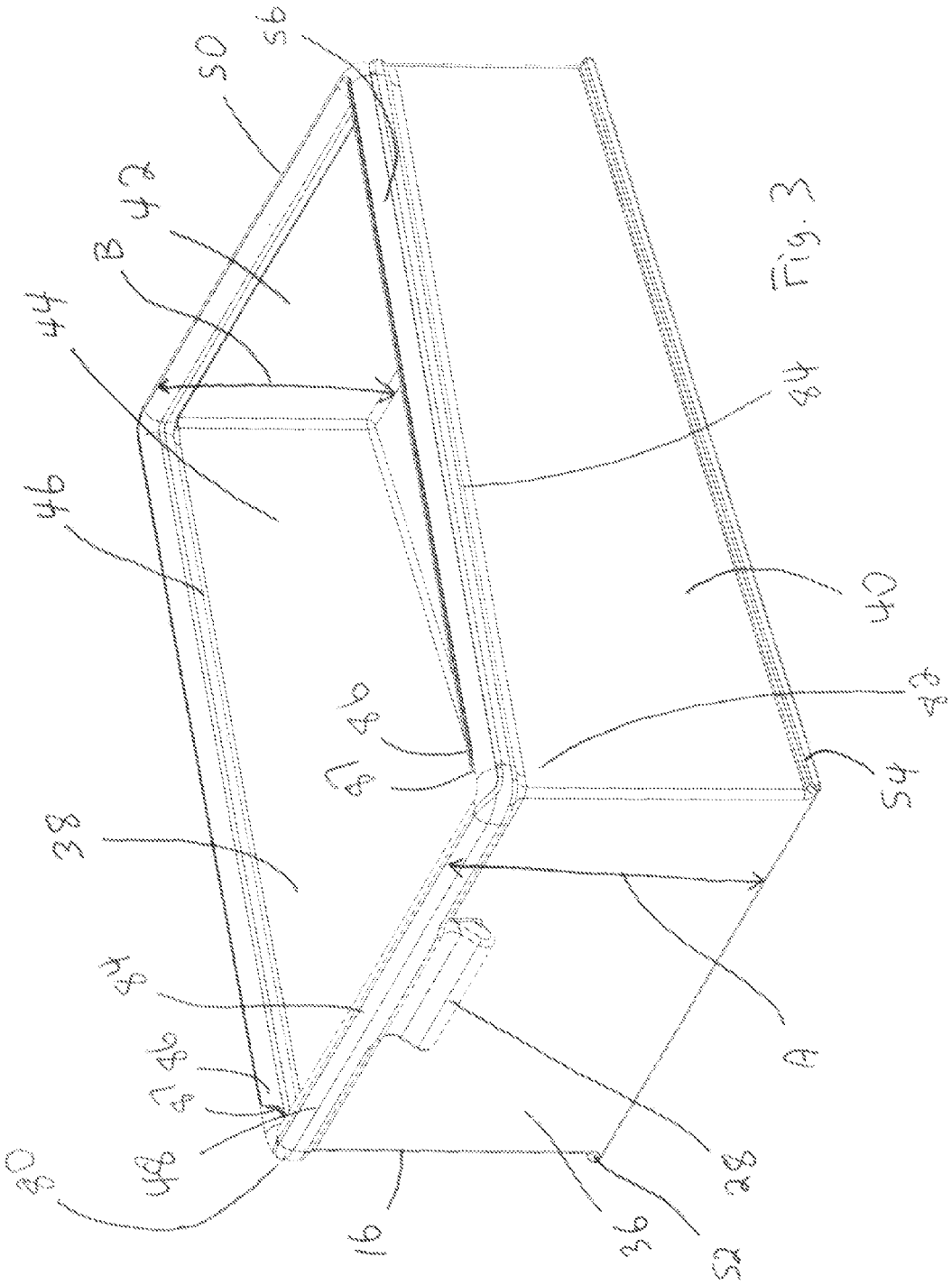
FIG. 3 is a perspective view of the drawer portion of the storage container shown in FIG. 1.

Referring now to FIG. 3, drawer 16 consists of a roughly rectangular box having front wall 36, back wall 42, side walls 38 and 40, open top 44 and circumscribing rim 46 surrounding the open top. Front wall 36 is rectangular and has height A while rear wall 42 is also rectangular and has height B, which is less than height A. This means that front 48 of drawer 16 is larger than back 50. Circumscribing rim 46 has a gasket 56 which extends along the entire rim so as to surround open top 44.

Figure 4:
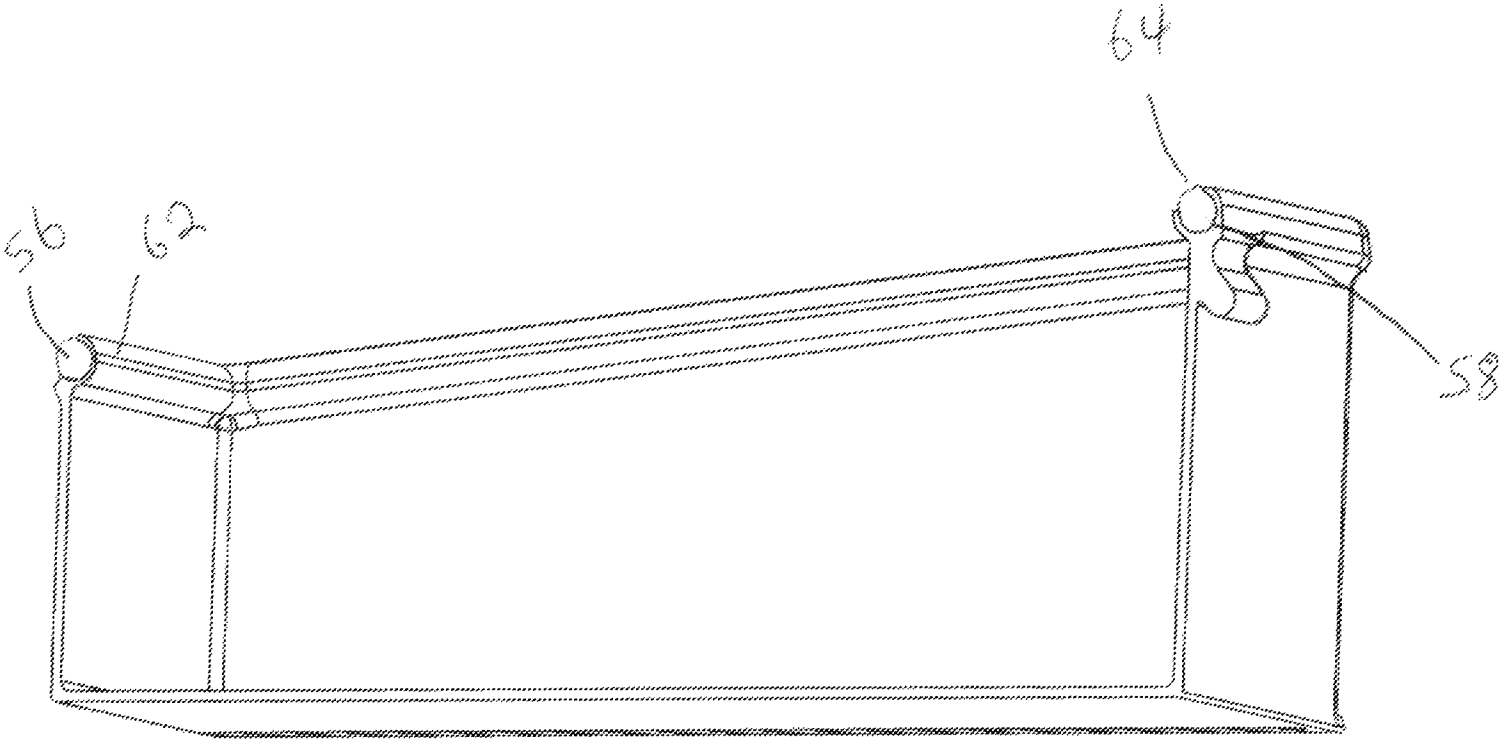
FIG. 4 is a perspective view, partly in cross section of the drawer shown in FIG. 3.

Referring now to FIG. 4, circumscribing rim 46 has a channel 58 which semi-circular in profile and dimensioned to snuggly retainer gasket 56. Gasket 56 is essentially an annular polymer gasket which is soft and resilient. Channel 58, having a semi-circular cross sectional profile, leaves portion 64 of gasket 56 exposed where the channel is opened. Channel 58 is oriented such that portion 60 of the channel which runs on top of front wall 36 is opened towards back 50 of drawer 16. Likewise, portion 62 of channel 58 which runs on top of back wall 42 is configured such that it opens backward. This ensures that exposed portion 64 of the gasket where it is mounted above walls 36 and 42 is directed towards the rear of drawer 16. Channel 58 where it extends along the side walls is configured such that the exposed portion 64 of the gasket is oriented outwardly. To ensure that gasket 56 fits snuggly in channel 58, the gasket is slightly shorter than the length of the channel such that the gasket must be slightly stretched to fit within the channel.

Figure 5:
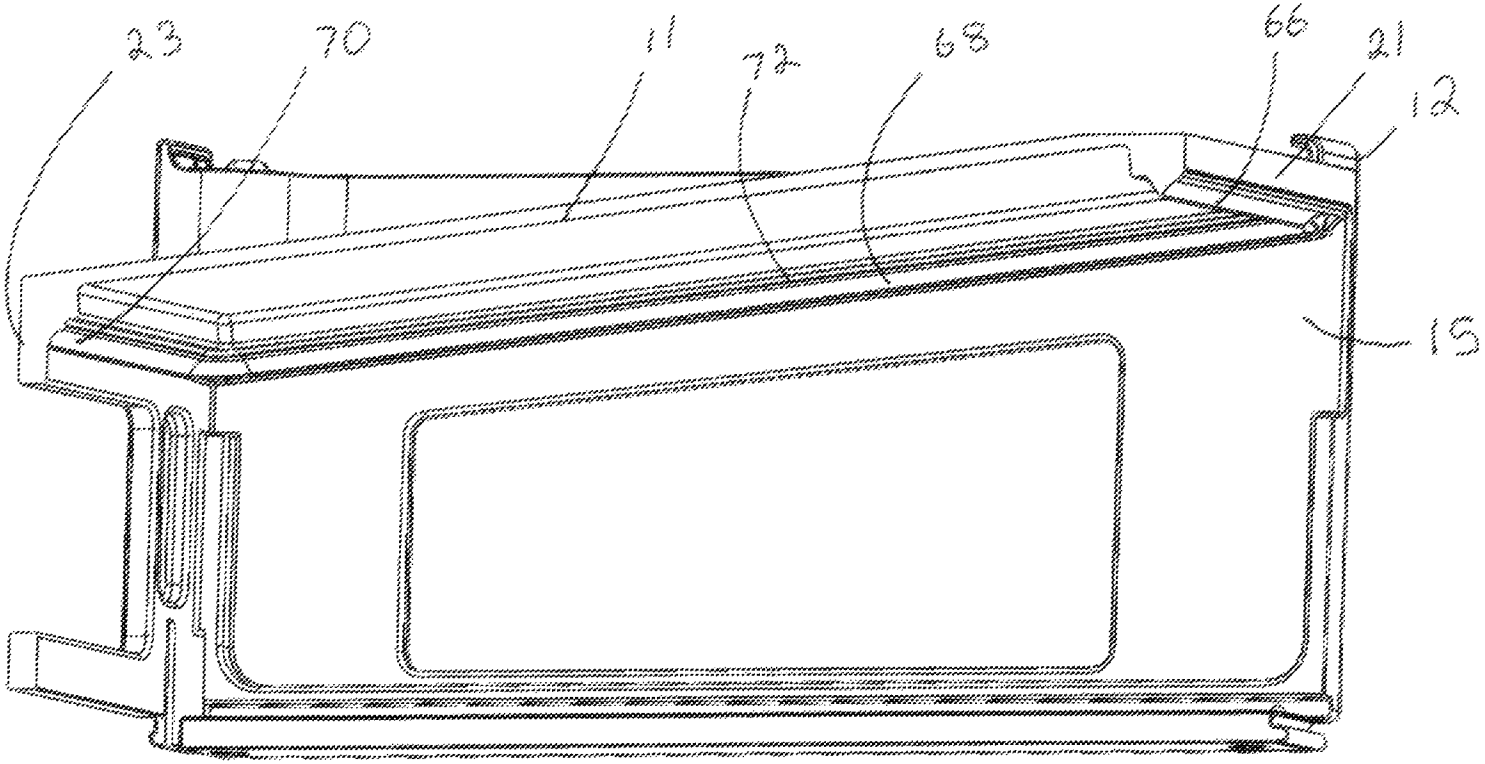
FIG. 5 is a perspective taken from underneath and partly in cross section of the housing shown in FIG. 2.

Referring now to FIG. 5, housing 12 has a peripheral rim 68 which extends completely around top wall 11. Peripheral rim 68 is concave and has a semi-circular cross sectional profile which is configured to match the profile of the gasket. Portions 66 and 70 of peripheral rim 68 is oriented towards front 21 of housing 12. Portion 72 of rim 68 is oriented towards the inside of the housing. Portion 72 is also concave and is positioned above the side walls and oriented towards the centre of top wall 11. Likewise, portion 66 is also concave and oriented towards the front of the housing. With the concave portions of the peripheral rim oriented towards the centre and front of the housing, the concave portions of the rim will make intimate contact with the gasket when the drawer is fully inserted into the housing.

Figure 6:
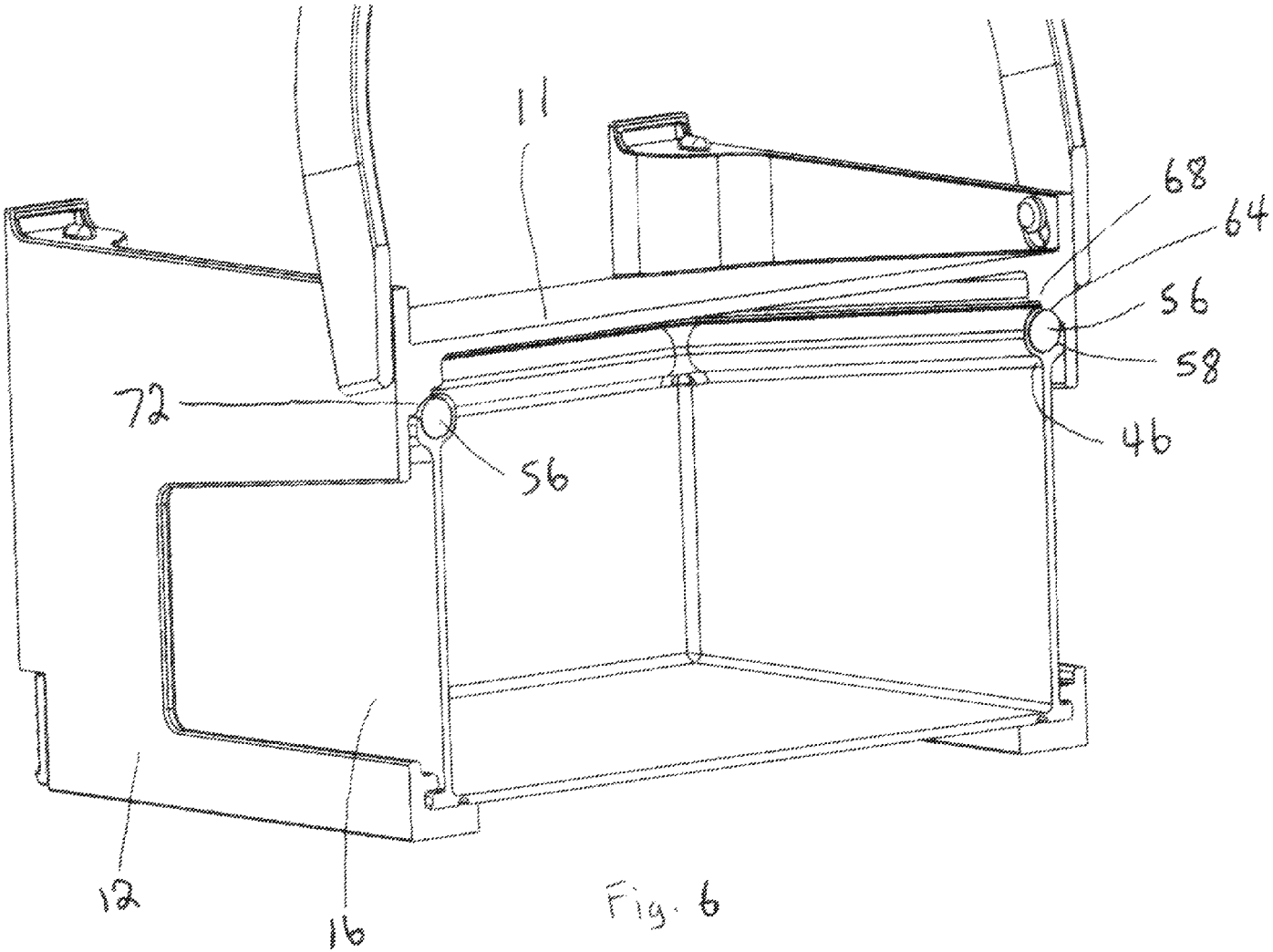
FIG. 6 is a perspective view taken in cross section of the drawer portion within the housing portion of the storage container.

Referring now to FIG. 6, when drawer 16 is fully inserted into housing 12, circumscribing rim 46 of drawer 16 makes sealing contact with peripheral rim 68 of housing 12. Top wall 11 is dimensioned and shaped to completely close off open top 44 of drawer 16. Since top wall 11 is inclined, it will completely close off the open top when the drawer is in its fully inserted, fully closed position. With rims 46 and 68 in sealing contact, the container becomes substantially air tight when the drawer is in its fully closed position. The semi-circular cross sectional profiles of rims 46 and 68 ensure intimate contact between the gasket 56 and both rims, ensuring little or no air to pass through the seal between the two rims. The sloping shape of drawer 16, with a larger front wall relative to the back wall ensures that the drawer can easily slid into its fully closed position without the gasket sliding and rubbing against rim 68. In fact, the present invention ensures that the gasket makes contact with rim 68 only when the drawer is fully closed. This improves the life of the gasket and makes opening and closing the drawer much easier. As mentioned previously, channel 58 is preferably semi-circular in cross section. More preferably, the profile of channel 58 is greater than 180° of a circular profile to ensure that gasket 56 fits firmly within the channel. Exposed portion 64 of gasket 56 makes intimate contact with surface 72 of peripheral rim 68 when drawer 16 is fully inserted into housing 12. A biasing notch and knob (not shown) can be incorporated into the design of tongue 54 and groove 32 to ensure that the drawer is biased towards the housing when the drawer is fully inserted into the housing.

Figure 7:
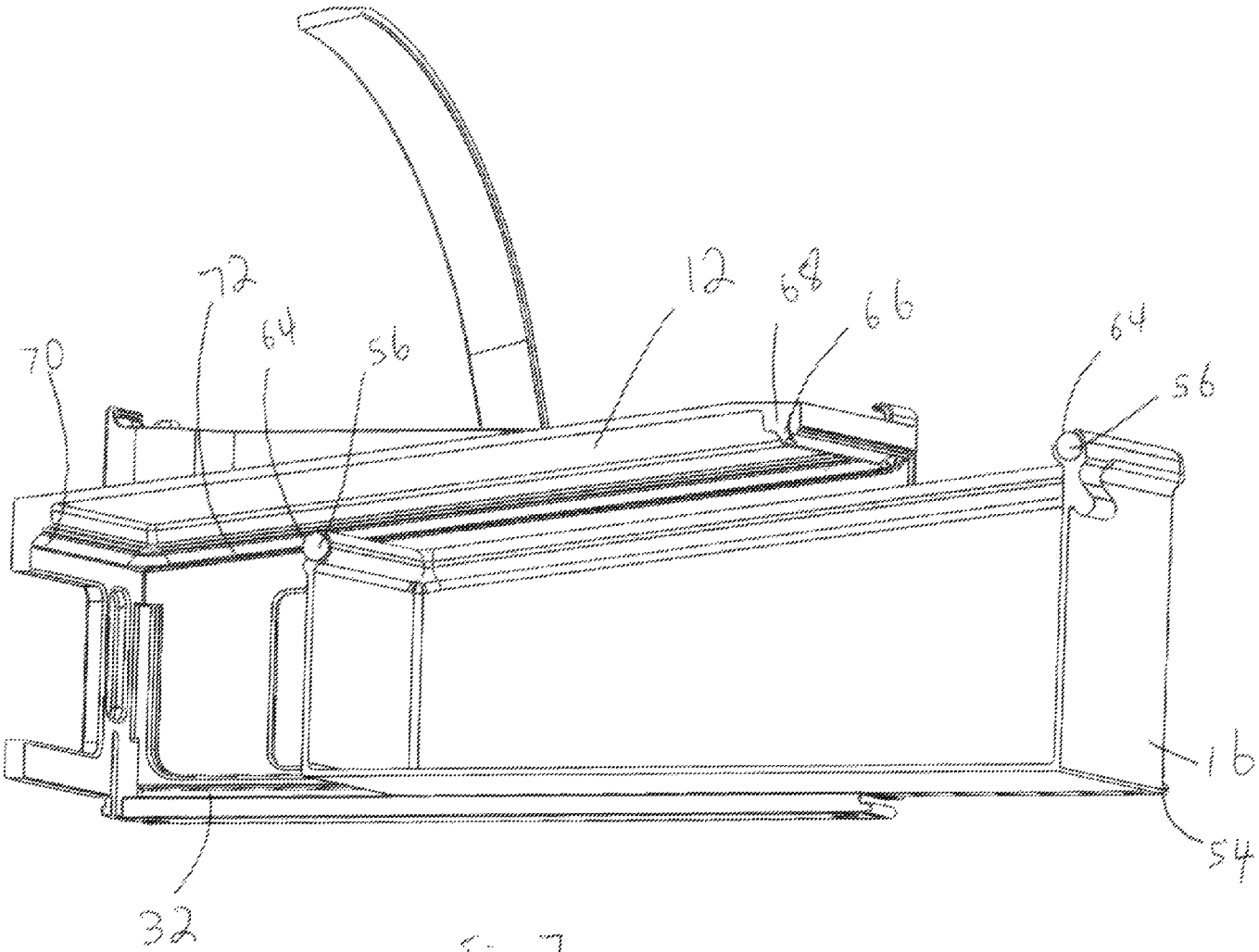
FIG. 7 is a perspective view taken in long section of the drawer portion within the housing portion with the drawer portion partially pulled out of the housing portion.

Referring now to FIG. 7, drawer 16 is inserted into housing 12 by aligning tongue portions 54 of the drawer with grooves 32 of the housing and then inserting the tongues into the grooves. This permits the drawer to slide into the housing. The exposed portions 64 gasket 56 are positioned towards concave surfaces 66 and 70. As mentioned above, the gasket is also oriented towards concave surface 72 above the side walls of the housing; however, the housing and drawer are configured such that the gasket does not physically contact surface 72 until the drawer is fully inserted into the housing.

Figure 8:
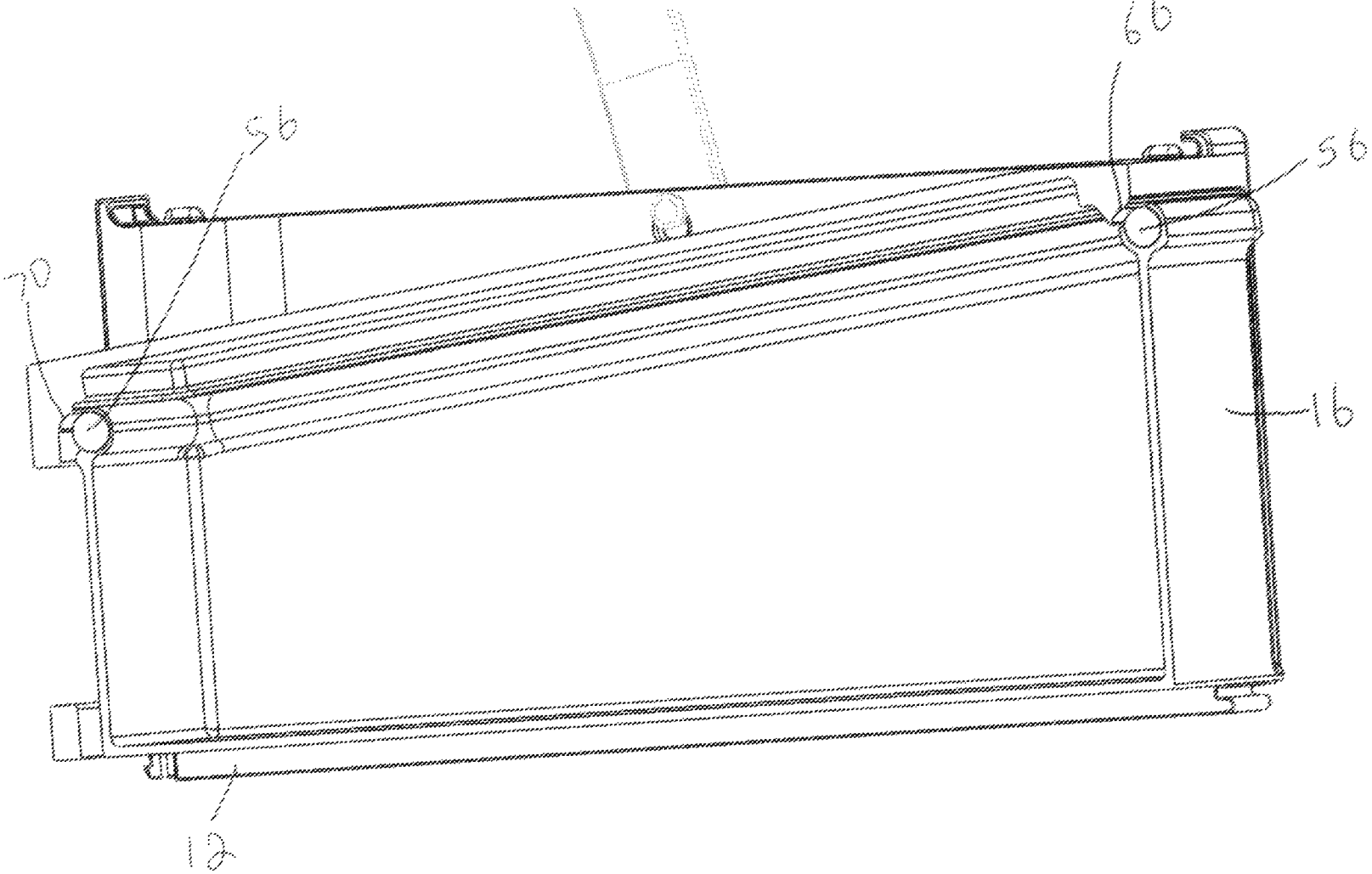
FIG. 8 is a perspective view taken in long section of the drawer portion within the housing portion with the drawer portion nearly fully contained within the housing portion.
Figure 9:
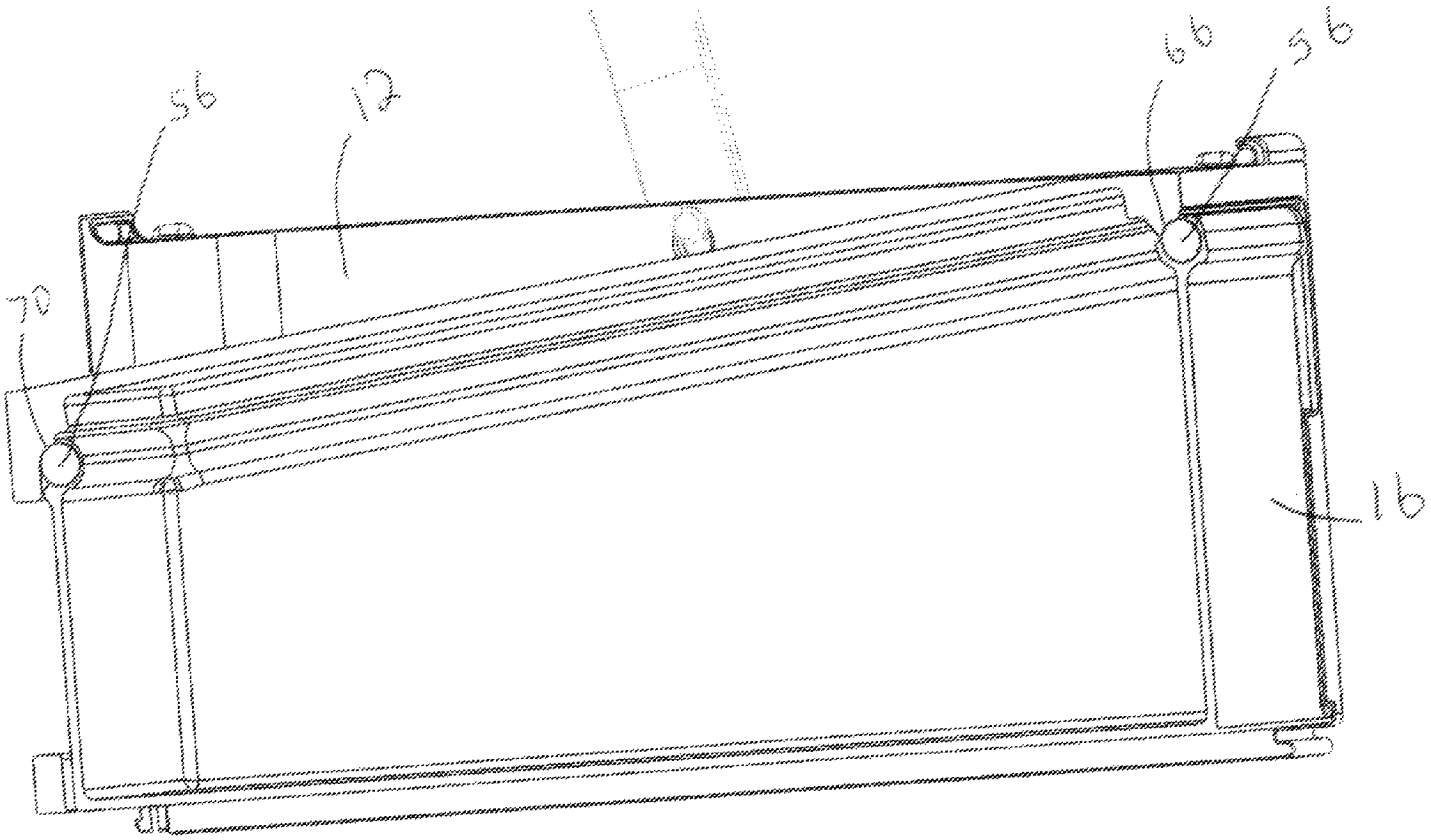
FIG. 9 is a perspective view taken in long section of the drawer portion within the housing portion with the drawer portion fully inserted into the housing portion.

As seen in FIGS. 8 and 9, gasket 56 only contacts surfaces 70 and 66 when drawer 16 is fully inserted into housing 12.

Referring back to FIG. 3, corners 80 and 82 of drawer 16 require some specific structure to enable gasket 56 to be oriented correctly. In particular, channel 58 or circumscribing rim 46 is defined by an inner lip 86 which extends along rim 46 towards the inside of drawer 16 and outer lip 84 which is oriented outside drawer 16. Gasket 56 is positioned between inner lip 86 and outer lip 84. Outer lip 80 is positioned higher than inner lip 86 along the top of front wall 36. Outer lip 80 is positioned lower than inner lip 86 along the sides and back of the drawer. At corners 80 and 82, a portion of inner lip 86 is cut away to form notch 87 which extends from corner 80 to 82 to allow the gasket to be oriented towards the back of the drawer.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A storage container for storing goods, the container comprising:

a. A drawer having a front wall, a back wall, side walls, a bottom and an open top, a handle formed on the front wall, the front and back walls each having a height, the height of the front wall being greater than the height of the back wall, the front wall, side walls and the back wall forming a circumscribing rim surrounding the open top;

b. A housing for containing the drawer, the housing having a top wall and opposite side walls depending from the top wall, the top wall having an underside with a peripheral rim formed thereon, the side walls of the housing and the side walls of the drawer configured to have tongue and groove connectors to permit the drawer to slide in and out of the housing between an open position wherein the drawer is pulled out of the housing and a closed position wherein the drawer is fully contained within the housing;

c. The top wall of the housing being inclined such that when the drawer is in its closed position the top wall of the housing closes off the open top of the drawer with the circumscribing rim of the drawer sealing against the peripheral rim of the housing, d. An elongated gasket positioned in an elongated channel formed in the peripheral rim, the elongated channel having a concave profile configured to retain the elongated gasket, the elongated channel extending to enclose the entire open top, the channel being further configured such that a portion of the gasket extending all the way around the open top is exposed to make sealing contact with the peripheral rim when the drawer is in its fully closed position;

e. wherein the channel is defined by an inner lip oriented towards an inside of the drawer and an outer lip oriented towards the outside of the drawer, the gasket being positioned between the inner and outer lips, the inner lip being positioned higher than the outer lip along the back wall and side walls of the drawer, the outer lip being positioned higher than the inner lip along the front wall of the drawer.

* * * * *